US009463566B2

(12) United States Patent
Yoshikane et al.

(10) Patent No.: US 9,463,566 B2
(45) Date of Patent: Oct. 11, 2016

(54) AUXILIARY HANDLE AND RECIPROCATING POWER TOOL HAVING THE SAME

(71) Applicant: MAKITA CORPORATION, Anjo-shi, Aichi (JP)

(72) Inventors: Kiyonobu Yoshikane, Anjo (JP); Yoshitaka Machida, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 34 days.

(21) Appl. No.: 14/287,818

(22) Filed: May 27, 2014

(65) Prior Publication Data

US 2014/0352114 A1 Dec. 4, 2014

(30) Foreign Application Priority Data

May 29, 2013 (JP) ..... 2013-113515

(51) Int. Cl.

| | |
|---|---|
| ***B25G 1/01*** | (2006.01) |
| ***B25F 5/02*** | (2006.01) |
| ***B25D 17/04*** | (2006.01) |
| ***B25F 5/00*** | (2006.01) |

(52) U.S. Cl.

CPC ..... *B25F 5/02* (2013.01); *B25D 17/04* (2013.01); *B25D 17/043* (2013.01); *B25F 5/006* (2013.01); *B25F 5/026* (2013.01); *B25G 1/01* (2013.01); *Y10T 16/4713* (2015.01)

(58) Field of Classification Search

CPC ... B25D 17/043; B25D 17/046; B25F 5/024; B25F 5/026; B25G 1/01; Y10T 16/4713

See application file for complete search history.

(56) References Cited

U.S. PATENT DOCUMENTS

| | | | | |
|---|---|---|---|---|
| 1,503,348 | A * | 7/1924 | Bruhn | B62D 1/043 16/426 |
| 3,148,568 | A * | 9/1964 | Hoza | B25F 5/026 294/31.2 |
| 3,341,235 | A * | 9/1967 | Mattson | A01D 34/84 16/426 |
| 4,276,675 | A * | 7/1981 | Pioch | B23B 45/001 16/426 |
| 4,368,556 | A * | 1/1983 | Wanner | B23B 45/001 16/436 |
| 6,499,219 | B1 * | 12/2002 | Wightman | B25F 5/024 33/334 |
| D487,686 | S * | 3/2004 | Milbourne | D8/70 |
| 6,913,088 | B2 * | 7/2005 | Berger | B25D 11/005 173/201 |

(Continued)

FOREIGN PATENT DOCUMENTS

| | | |
|---|---|---|
| DE | 10 2009 000598 A1 | 8/2009 |
| GB | 2484811 A | 4/2012 |

(Continued)

OTHER PUBLICATIONS

Oct. 9, 2015 Search Report issued in European Application No. 141702993.

*Primary Examiner* — Jeffrey O Brien

(74) *Attorney, Agent, or Firm* — Oliff PLC

(57) ABSTRACT

An effective technique for increasing performance of an auxiliary handle which is attached to a power tool is provided. The auxiliary handle has a grip part, a grip holding part, a mounting part and a support part. The grip holding part is disposed between the grip part and the support part in a longitudinal direction of the auxiliary handle. When the auxiliary handle is attached to a power tool body, the grip part and the grip holding part are held so as to be movable with respect to the mounting part with the support part as a fulcrum.

11 Claims, 6 Drawing Sheets

(56) References Cited

U.S. PATENT DOCUMENTS 7,137,542 B2 * 11/2006 Oki ..... B25D 17/043 173/162.1
D534,407 S * 1/2007 Waldron ..... D8/69
7,721,390 B2 * 5/2010 Pfeiffer ..... B25D 17/043 16/426
8,132,296 B2 * 3/2012 Di Nicolantonio ..... B25F 5/026 16/426
8,235,136 B2 * 8/2012 Berger ..... B25D 11/005 173/109
8,256,528 B2 * 9/2012 Oesterle ..... B25F 5/006 173/162.1
8,407,860 B2 * 4/2013 Brennenstuhl ..... B25F 5/026 16/422
8,430,180 B2 * 4/2013 Gumpert ..... B25D 16/003 173/162.1
8,448,300 B2 * 5/2013 Imaschewski ..... B25F 5/026 16/426
8,756,766 B2 * 6/2014 Zhang ..... B25F 5/006 16/421
8,813,868 B2 * 8/2014 Limberg ..... B25F 5/026 16/421
8,914,947 B2 * 12/2014 Weiss ..... B25D 17/043 16/426
9,061,412 B2 * 6/2015 Hahn ..... B25D 17/043
2005/0082072 A1 4/2005 Nicolantonio et al.
2005/0249564 A1 * 11/2005 Van Bergen ..... B25F 5/026 408/241 R
2010/0206595 A1 * 8/2010 Kamegai ..... B25F 5/006 173/162.2
2010/0282484 A1 * 11/2010 Moessnang ..... B25D 17/043 173/162.2
2011/0011609 A1 * 1/2011 Simm ..... B25D 17/04 173/171
2011/0215539 A1 * 9/2011 Van Der Linde ... B23B 31/1238 279/147
2012/0160534 A1 * 6/2012 Von Saucken ..... B25F 5/026 173/170
2013/0025088 A1 * 1/2013 Weiss ..... B25D 17/043 16/431
2014/0020210 A1 * 1/2014 Brennenstuhl ..... B25F 5/026 16/426
2014/0144656 A1 * 5/2014 Roehm ..... B25F 5/026 173/46
2014/0196921 A1 * 7/2014 Kondo ..... B25F 5/02 173/46
2014/0223695 A1 * 8/2014 Rieger ..... B25F 5/006 16/421
2014/0231113 A1 * 8/2014 Steurer ..... B23Q 11/0078 173/1
2014/0251649 A1 * 9/2014 Kondo ..... B23Q 9/00 173/170
2014/0251650 A1 * 9/2014 Kondo ..... B25F 5/026 173/171
2015/0174753 A1 * 6/2015 Kamiya ..... B25F 5/008 173/170
2015/0328765 A1 * 11/2015 Schubert ..... B25F 5/026 16/426

FOREIGN PATENT DOCUMENTS

JP A-2005-81517 3/2005
WO 2009/101061 A1 8/2009
WO WO2011/100025 * 8/2011

* cited by examiner

AUXILIARY HANDLE AND RECIPROCATING POWER TOOL HAVING THE SAME

CROSS REFERENCE TO RELATED APPLICATION

The present application claims priority from Japanese Patent Applications No. 2013-113515 filed on May 29, 2013, the disclosure of which is incorporated herein by reference in its entirety.

FIELD OF THE INVENTION

The present invention relates to an auxiliary handle which is detachably attached to a reciprocating power tool, and a reciprocating power tool having the auxiliary handle.

BACKGROUND OF THE INVENTION

Japanese non-examined laid-open Patent Publication No. 2005-081517 discloses a vibration-proof handle which is attached to a power tool. In this vibration-proof handle, a rotary shaft is disposed on the power tool body side within a grip part which is held by a user, and a compression spring is disposed in an end region on the side opposite to the power tool body side within the grip part.

DISCLOSURE OF THE INVENTION

Problems to be Solved by the Invention

In the above-described vibration-proof handle in which the rotary shaft is disposed within the grip part, however, rotation of the grip part may be controlled by the grip part itself. Therefore, further improvement of the auxiliary handle is required in this point.

Accordingly, it is an object of the present invention to improve performance of an auxiliary handle which is attached to a power tool.

Means for Solving the Problems

The above-described problem is solved by the present invention. According to a preferred embodiment of the present invention, an elongate auxiliary handle is provided which is detachably attached to a reciprocating power tool in which a tool bit is caused to reciprocate in a predetermined direction. Typically, the auxiliary handle is configured to be attached to a reciprocating power tool having a main handle. The auxiliary handle has a mounting part that is attached to a power tool body of the reciprocating power tool, a movable part that can move relatively with respect to the mounting part, and a connection part that connects the mounting part and the movable part. The movable part has a grip part which is held by the user and a base which is disposed between the grip part and the connection part in a longitudinal direction of the auxiliary handle. When the auxiliary handle is attached to the power tool body such that the longitudinal direction of the auxiliary handle crosses the predetermined direction, the movable part is held so as to be movable in the predetermined direction with respect to the mounting part with the connection part as a fulcrum. The movable part only needs to be held so as to relatively move at least in the predetermined direction, but it may also be provided to relatively move in other directions. Further, the movable part is preferably biased toward an initial position by a restoring force of the connection part. In this case, it is preferred to utilize a restoring force of an elastic element such as a spring, rubber or resin.

According to the present invention, by provision of the base between the grip part and the connection part in the longitudinal direction of the auxiliary handle, the amount of movement of the grip part with respect to the mounting part attached to the power tool body is increased. Therefore, vibration which is caused in the power tool body is effectively prevented from being transmitted to the user holding the auxiliary handle. Thus, vibration-proofing performance of the auxiliary handle is enhanced.

According to a further embodiment of the auxiliary handle, when the auxiliary handle is attached to the power tool body such that the longitudinal direction of the auxiliary handle crosses the predetermined direction, the connection part and the grip part are disposed, in the longitudinal direction, on opposite sides of a drive axis of the tool bit extending in the predetermined direction. In other words, the connection part and the grip part are disposed on opposite sides of a plane which is perpendicular to the longitudinal direction of the auxiliary handle and includes the drive axis of the tool bit.

According to this embodiment, with the construction in which the connection part and the grip part are disposed farther away from each other, the amount of movement of the grip part with respect to the mounting part is increased. As a result, transmission of vibration to the user holding the auxiliary handle is more effectively reduced.

According to a further embodiment of the auxiliary handle, the mounting part, the movable part and the connection part is integrally formed of a single material. In other words, the mounting part, the movable part and the connection part is formed as a one piece component.

According to this embodiment, by provision of the integral structure formed of a single material, it is not necessary to assemble a plurality of parts.

According to a further embodiment of the auxiliary handle, when the auxiliary handle is attached to the power tool body such that the longitudinal direction of the auxiliary handle crosses the predetermined direction, the connection part has smaller bending rigidity (bending stiffness) in the predetermined direction than the mounting part and the movable part, respectively. The movable part is caused to move with respect to the mounting part by elastic deformation of the connection part.

According to this embodiment, with the construction in which the connection part has smaller bending rigidity, the connection part is more elastically deformable than the other parts. Therefore, the movable part effectively moves with respect to the mounting part.

According to a further embodiment of the auxiliary handle, the auxiliary handle is formed of resin material and the connection part has a bending rigidity reducing part. The bending rigidity reducing part suitably comprises a hole, a groove, a notch or the like which is formed in the connection part.

According to this embodiment, with the construction in which the auxiliary handle is formed of resin material, the bending rigidity reducing part is easily formed.

According to a further embodiment of the auxiliary handle, the auxiliary handle has a movement amount controlling part for controlling the amount of movement of the movable part with respect to the mounting part. Typically, the movement amount controlling part has a contact part which contacts with the movable part when the movable part is moved in a predetermined distance.

According to this embodiment, with the construction in which the amount of relative movement of the movable part is set by the movement amount controlling part, the movable part is controlled not to move more than expected. As a result, the connection part which serves as a fulcrum is protected.

According to a further embodiment of the auxiliary handle, the auxiliary handle has a fastening member for fastening the mounting part to the power tool body. The fastening member has a projection protruding from the mounting part in a state that the mounting part is mounted to the power tool body. The projection can contact with the movable part. The projection serves as the movement amount controlling part by contact with the movable part. Typically, the fastening member comprises a screw, a pin or other similar members. Accordingly, the projection is formed by a stem of the screw, the pin or other similar members.

According to this embodiment, with the construction in which the projection which is a part of the fastening member forms the movement amount controlling part, the fastening member has two functions, that is, the fastening member has a function of fastening the mounting part and a function as the movement amount controlling part.

According to a further embodiment of the auxiliary handle, the fastening member has an operation part which is manually operated by a user in order to fasten the mounting part to the power tool body. The operation part can contact with the base and serves as the movement amount controlling part which controls the amount of movement of the base in a direction crossing both the predetermined direction and the longitudinal direction by contact with the base and thus controls the amount of relative movement of the movable part. In the operation part, typically, the fastening member in the form of an elongate member such as a screw or a pin is arranged to penetrate through the base.

According to this embodiment, with the construction in which the operation part forming a part of the fastening member may form the movement amount controlling part, the operation part has two functions, that is, the operation part has a function of being operated to fasten the mounting part and a function as the movement amount controlling part.

According to a further embodiment of the auxiliary handle, the base can contact with the mounting part. The mounting part serves as the movement amount controlling part which controls the amount of movement of the base in a direction crossing both the predetermined direction and the longitudinal direction by contact with the base and thus controls the amount of relative movement of the movable part.

According to this embodiment, with the construction in which the mounting part for attaching the auxiliary handle to the power tool body may form the movement amount controlling part, the mounting part has two functions, that is, the mounting part has a function of attaching the auxiliary handle to the power tool body and a function as the movement amount controlling part.

According to a further embodiment of the auxiliary handle, when the auxiliary handle is attached to the power tool body such that the longitudinal direction of the auxiliary handle crosses the predetermined direction, the movable part is held so as to be movable in the predetermined direction with respect to the mounting part with the connection part as a fulcrum and elastically biased toward an initial position by the connection part. In a case that the connecting part is formed by elastic material such as rubber or resin, the movable part is biased by the restoring force of the elastic material. On the other hand, the connection part may include a support shaft and a biasing member. In this case, the connection part holds the movable part so as to be rotatable around the support shaft. The biasing member biases the movable part toward an initial position. The biasing member suitably includes a spring, rubber, resin and other similar elastic members.

According to this embodiment, with the construction in which the biasing member biases the movable part toward the initial position, the movable part returns to the initial position after being relatively moved. As a result, transmission of vibration to the user holding the auxiliary handle is more effectively reduced.

According to a preferred embodiment of a reciprocating power tool of the present invention, the reciprocating power tool having the above-described auxiliary handle is provided. The reciprocating power tool has the power tool body to which the auxiliary handle is attached, and the main handle connected to the power tool body.

Effect of the Invention

Accordingly, performance of the auxiliary handle which is attached to the power tool is improved.

Other objects, features and advantages of the invention will be readily understood after reading the following detailed description together with the accompanying drawings and the claims.

BEST MODES FOR PERFORMING THE INVENTION

Each of the additional features and method steps disclosed above and below may be utilized separately or in conjunction with other features and method steps to provide and manufacture improved auxiliary handles and reciprocating power tools and method for using such auxiliary handles and the reciprocating power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
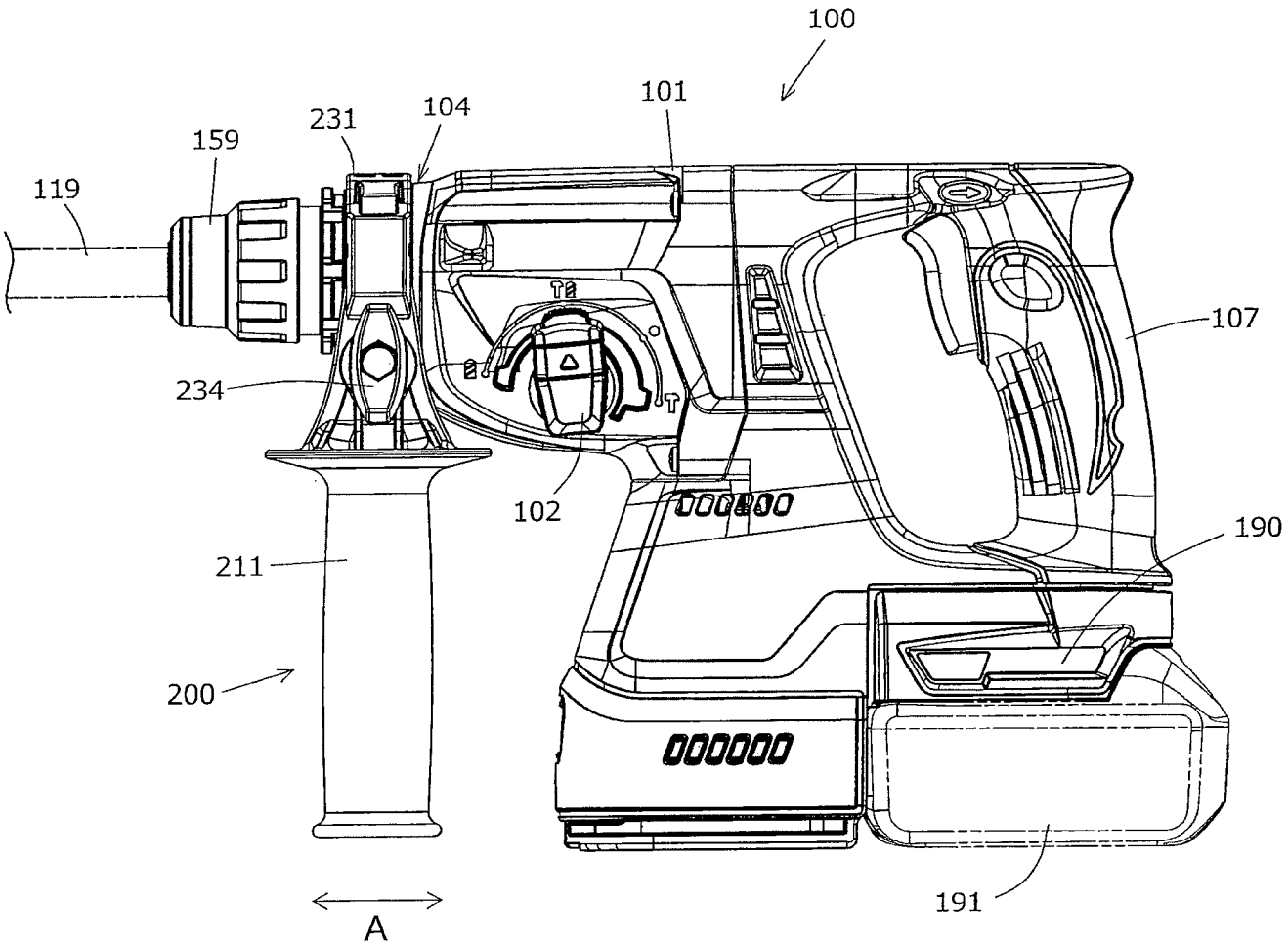
FIG. 1 is a side view showing a hammer drill with an auxiliary handle according to a first embodiment attached thereto.

A first embodiment of this invention is now described with reference to FIGS. 1 to 5. As shown in FIG. 1, an auxiliary handle 200 is removably (detachably) attached to a hammer drill 100. The hammer drill 100 mainly includes a body 101, a handgrip 107 and a hammer bit 119.

As shown in FIG. 1, the body 101 has a tool holder 159 and a barrel 104 in front. The barrel 104 houses the tool holder 159 in part. The hammer bit 119 is detachably coupled to the tool holder 159. The handgrip 107 is connected to a rear of the body 101. Further, a battery mounting part 190 to which a battery pack 191 is detachably mounted is provided below the handgrip 107 in the body 101.

The body 101 houses a motor, and a power converting mechanism, a striking mechanism and a rotation transmitting mechanism which transmit an output of the motor to the hammer bit 119. With this construction, a hammering operation and a drilling operation are performed by the output of the motor transmitted to the hammer bit 119. The hammer drill 100 is constructed to perform a hammering operation, a drilling operation and a hammer drill operation. In the hammering operation, the hammer bit 119 is caused to reciprocate in an axial direction of the hammer bit 119. In the drilling operation, the hammer bit 119 is caused to rotate around an axis of the hammer bit 119. Further, in the hammer drill operation, the hammering operation and the drilling operation are performed at the same time. The operation mode of the hammer drill 100 can be switched by user's manual operation of a mode switching lever 102.

Figure 2:
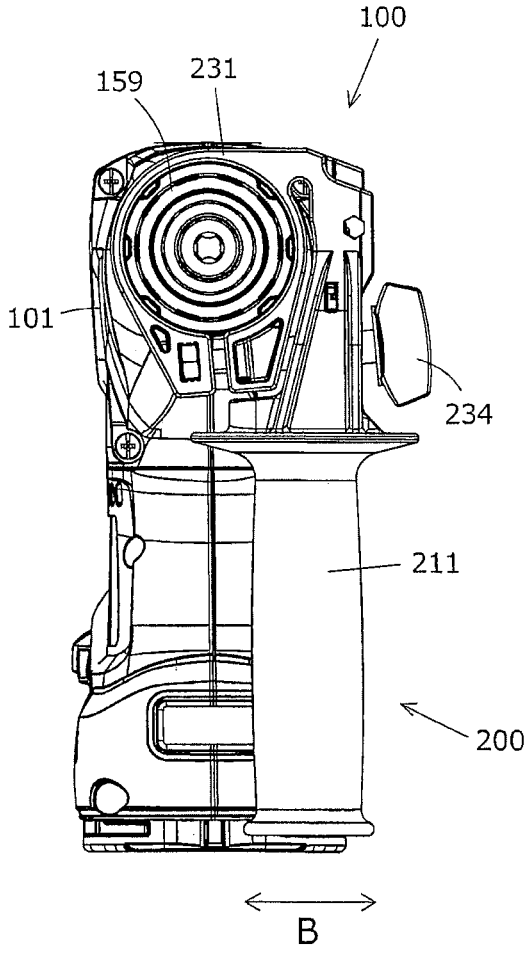
FIG. 2 is a front view showing the hammer drill with the auxiliary handle attached thereto.
Figure 3:
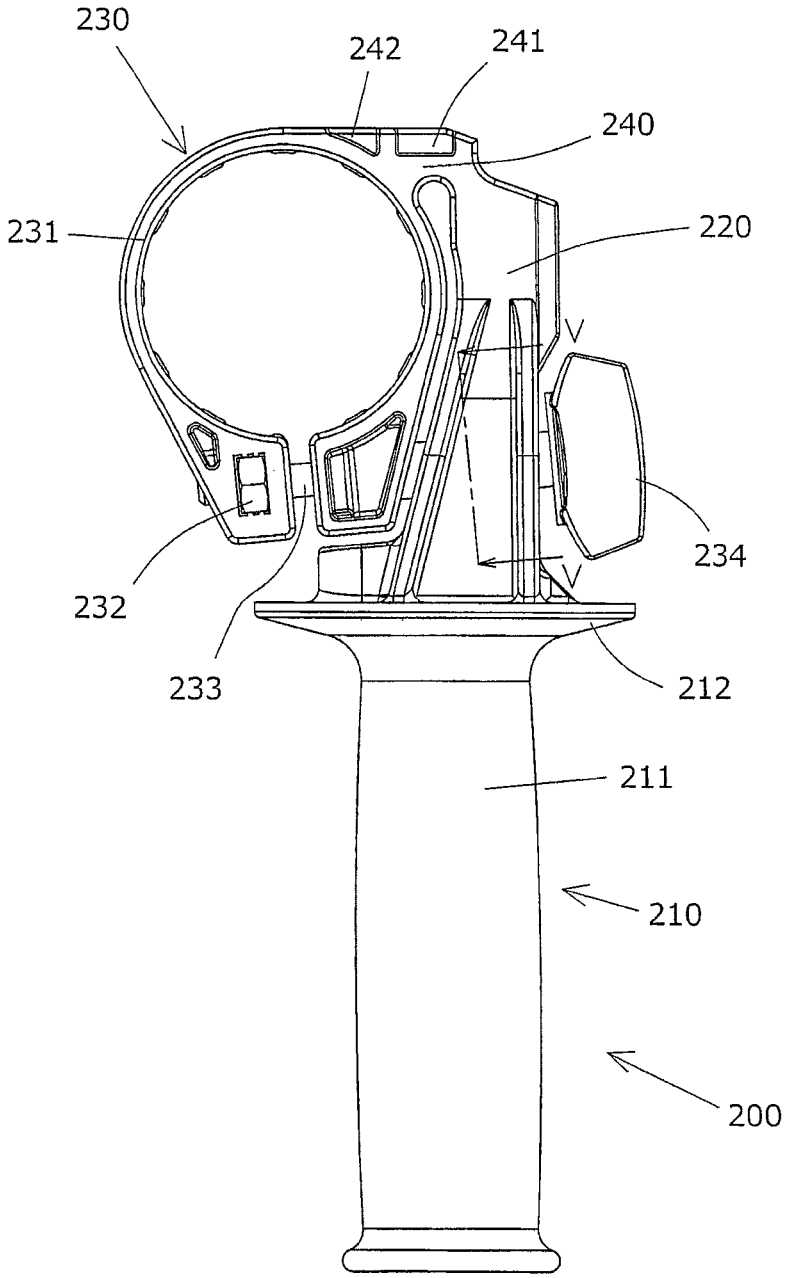
FIG. 3 is a plan view showing the auxiliary handle.

As shown in FIGS. 1 and 2, the auxiliary handle 200 is removably attached to the cylindrical barrel 104. As shown in FIG. 3, the auxiliary handle 200 mainly includes a grip part 210, a grip holding part 220, a mounting part 230 and a support part 240. Further, in FIGS. 1 and 2, for the sake of convenience of explanation, the grip part 210 is attached so as to extend downward from the barrel 104, but an extending direction of the grip part 210 from the barrel 104 can be adjusted.

Figure 4:
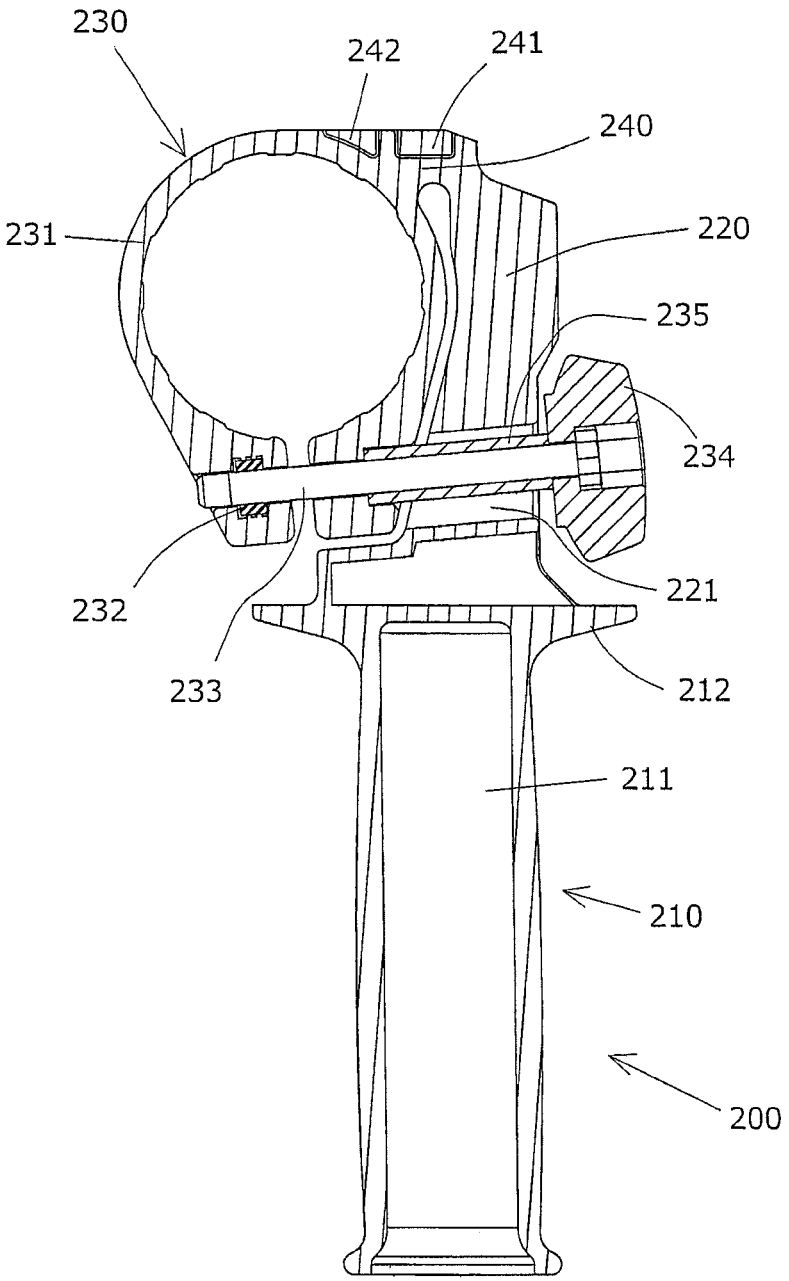
FIG. 4 is a sectional view showing the auxiliary handle.

As shown in FIGS. 3 and 4, the grip part 210 is configured as a cylindrical grip to be held by a user. The grip part 210 has an elongate grip 211 and a flange 212 formed on the grip holding part 220 side. The grip part 210 is a feature that corresponds to the "grip part" according to the present invention.

The mounting part 230 mainly includes a ring 231. The ring 231 is attached onto the barrel 104 of the hammer drill 100 and provided with a nut 232 and a bolt 233. A handle 234 and a sleeve 235 are provided on the bolt 233. When the bolt 233 is tightened by turning the handle 234, the sleeve 235 comes in contact with the ring 231 and the diameter of the ring 231 is reduced. In this manner, the mounting part 230 is attached to the barrel 104. The mounting part 230 is a feature that corresponds to the "mounting part" according to the present invention. Further, the nut 232 and the bolt 233 are features that correspond to the "fastening member" according to the present invention. The handle 234 is a feature that corresponds to the "operation part" according to the present invention.

Figure 5:
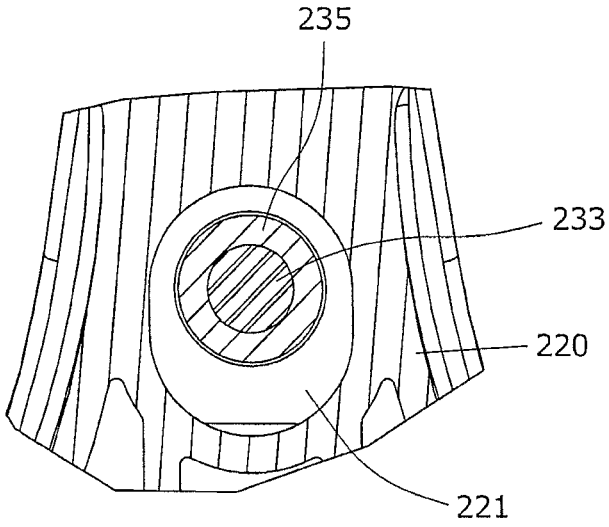
FIG. 5 is a sectional view taken along line V-V in FIG. 3.

As shown in FIG. 4, the grip holding part 220 is provided and configured to hold the grip part 210. Further, as shown in FIGS. 4 and 5, the grip holding part 220 has a through hole 221 through which the bolt 233 is inserted. As shown in FIG. 5, an outer circumferential surface of the sleeve 235 is not normally in contact with the through hole 221. Further, as shown in FIG. 2, when the auxiliary handle 200 is attached to the hammer drill 100, a clearance is provided between the grip holding part 220 and the handle 234. The grip holding part 220 is a feature that corresponds to the "base" according to the present invention.

The support part 240 connects the grip holding part 220 and the mounting part 230, and has a first opening 241 and a second opening 242 which are open to the outside. By provision of such a construction, as shown in FIG. 4, cross-sectional secondary moment of the support part 240 is set to be smaller than the other parts of the auxiliary handle 200. Therefore, the support part 240 allows relative movement of the grip part 210 and the grip holding part 220 with respect to the mounting part 230. The support part 240 is a feature that corresponds to the "connection part" according to the present invention. The first opening 241 and the second opening 242 are features that correspond to the "bending rigidity reducing part" according to the present invention.

The above-described auxiliary handle 200 is integrally formed of resin material. As the resin material, nylon such as glass fiber-containing polyamide 6, and elastomer are used. Thus, when the auxiliary handle 200 is attached to the hammer drill 100, the grip part 210 and the grip holding part 220 move with respect to the mounting part 230. The grip part 210 and the grip holding part 220 are features that correspond to the "movable part" according to the present invention.

As shown in FIG. 2, in the auxiliary handle 200, the mounting part 230 is attached to the barrel 104 by operating the handle 234. In the auxiliary handle 200 attached to the hammer drill 100, the support part 240 and the grip 211 are disposed on opposite sides of the axis of striking movement of the hammer bit 119 in the extending direction of the grip part 210. In other words, the support part 240 and the grip 211 are disposed on opposite sides of a plane which includes the axis of striking movement of the hammer bit 119 and crosses the extending direction of the grip 211. With this construction, vibration which is caused in the hammer drill 100 and transmitted to the user holding the grip part 210 is reduced.

Specifically, as shown in FIG. 1, in the hammer drill 100, vibration is caused mainly in the axial direction of the hammer bit 119 by hammering operation. At this time, by elastic deformation of the support part 240, the grip part 210 and the grip holding part 220 of the auxiliary handle 200 attached to the barrel 104 are caused to move with respect to the mounting part 230 in the axial direction of the hammer bit 119 (a direction A) which is shown by a (double-headed) arrow A. In other words, the support part 240 which is configured to have smaller bending rigidity than the other parts of the auxiliary handle 200 elastically deforms, which causes the grip part 210 and the grip holding part 220 to move in the direction A with the support part 240 as a fulcrum.

Vibration which is caused in the hammer drill 100 and transmitted to the user holding the grip part 210 is reduced by movement of the grip part 210 in the direction A. Further, by movement of the grip holding part 220 in the direction A, the sleeve 235 fitted on the bolt 233 comes in contact with the grip holding part 220. Thus, the amount of movement of the grip part 210 in the direction A is controlled. Therefore, the support part 240 is prevented from being destroyed by movement of the grip part 210. The sleeve 235 is a feature that corresponds to the "projection" and the "movement amount controlling part" according to the present invention.

Further, as shown in FIG. 2, by elastic deformation of the support part 240, the grip part 210 and the grip holding part 220 of the auxiliary handle 200 attached to the barrel 104 are caused to move with respect to the mounting part 230 in a direction shown by a (double-headed) arrow B (a direction B). During operation, vibration is caused mainly in the axial direction of the hammer bit 119, but vibration is also caused in a direction crossing the axial direction of the hammer bit 119. Therefore, by elastic deformation of the support part 240, the grip part 210 and the grip holding part 220 are also caused to move in the direction B with the support part 240 as a fulcrum.

Vibration which is caused in the hammer drill 100 and transmitted to the user holding the grip part 210 is reduced by movement of the grip part 210 in the direction B. Thus, transmission of vibration which is caused in a plurality of directions in the hammer drill 100 is reduced. Further, by movement of the grip holding part 220 in the direction B, the grip holding part 220 comes into contact with the handle 234 or the mounting part 230. Thus, the amount of movement of the grip part 210 in the direction B is controlled. Therefore, the support part 240 is prevented from being destroyed by movement of the grip part 210. The handle 234 and the mounting part 230 are features that correspond to the "movement amount controlling part" according to the present invention.

According to the above-described first embodiment, with the construction in which the support part 240 and the grip 211 are disposed on the opposite sides of the axis of striking movement of the hammer bit 119 in the extending direction of the grip part 210, the support part 240 and the grip 211 are disposed farther away from each other, the amount of movement of the grip 211 with respect to the mounting part 230 is increased. As a result, transmission of vibration to the user holding the auxiliary handle 200 is effectively reduced.

Further, in the first embodiment, the auxiliary handle 200 is integrally formed of resin material, but the present invention is not limited to this. For example, the grip part 210, the grip holding part 220, the mounting part 230 and the support part 240 may be formed as separate members from each other. In this case, the support part 240 is preferable to be an elastic element.

Second Embodiment

Figure 6:
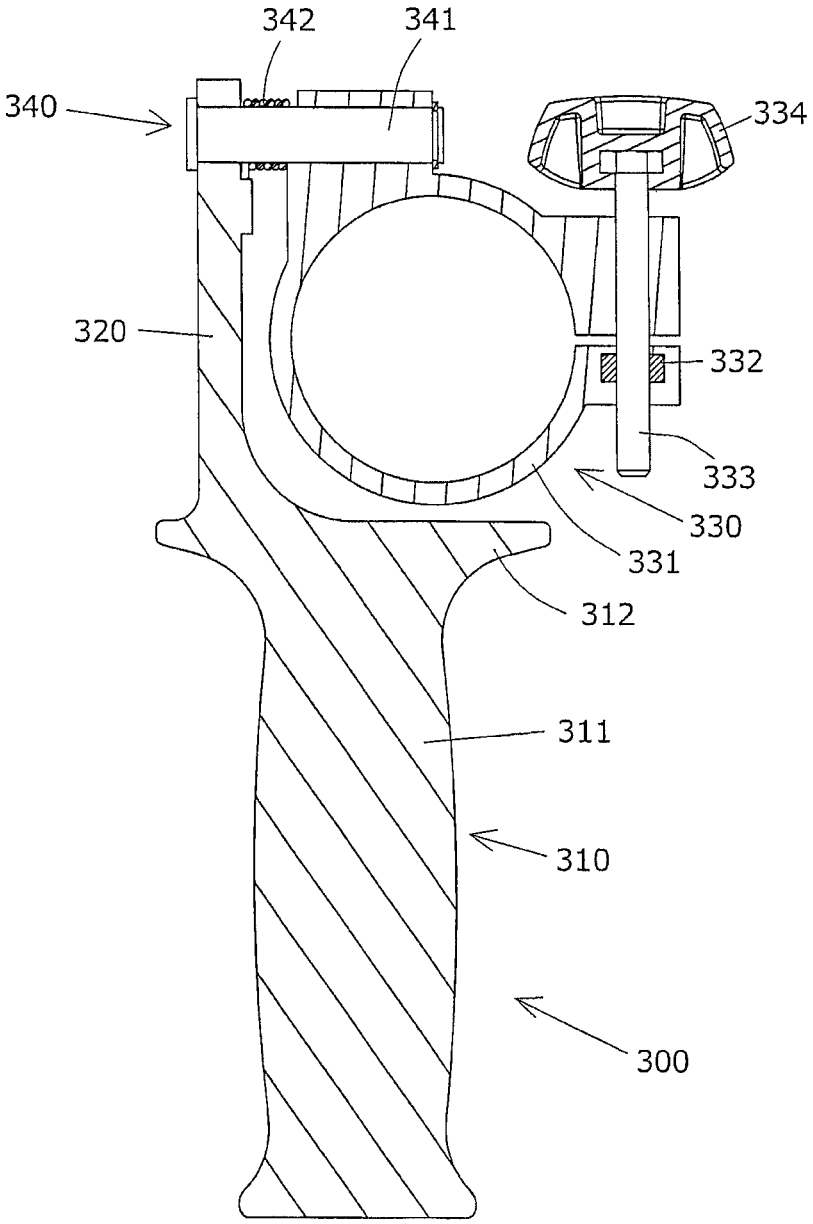
FIG. 6 is a sectional view showing an auxiliary handle according to a second embodiment.

A second embodiment of this invention is now described with reference to FIG. 6. Like in the first embodiment, an auxiliary handle 300 is removably (detachably) attached to the barrel 104 of the hammer drill 100. The auxiliary handle 300 mainly includes a grip part 310, a grip holding part 320, a mounting part 330 and a support part 340.

The grip part 310 has an elongate grip 311 and a flange 312 formed on the grip holding part 320 side. The grip part 310 is a feature that corresponds to the "grip part" according to the present invention.

The mounting part 330 mainly includes a ring 331. The ring 331 is provided with a nut 332 and a bolt 333. A handle 334 is provided on the bolt 333. When the bolt 333 is tightened by turning the handle 334, the mounting part 330 is attached to the barrel 104. The mounting part 330 is a feature that corresponds to the "mounting part" according to the present invention.

The grip holding part 320 is provided and configured to hold the grip part 310. The grip holding part 320 and the grip part 310 are integrally formed with each other. The grip holding part 320 is a feature that corresponds to the "base" according to the present invention.

The support part 340 connects the grip holding part 320 and the mounting part 330, and mainly includes a shaft 341 and a torsion spring 342. The grip part 310 and the grip holding part 320 are supported by the shaft 341 such that they can rotate with respect to the mounting part 330. The torsion spring 342 is disposed around the shaft 341 between the grip holding part 320 and the mounting part 330. One end of the torsion spring 342 is held by the grip holding part 320 and the other end is held by the mounting part 330. With such a construction, the torsion spring 342 biases the grip part 310 to retain the grip part 310 in a predetermined initial position with respect to the mounting part 330. The support part 340 is a feature that corresponds to the "connection part" according to the present invention. Further, the shaft 341 and the torsion spring 342 are features that correspond to the "support shaft" and the "biasing member", respectively, according to the present invention.

Like in the first embodiment, in the auxiliary handle 300 attached to the hammer drill 100, the support part 340 and the grip 311 are disposed on the opposite sides of the axis of the striking movement of the hammer bit 119 in the extending direction of the grip part 310. In other words, the support part 340 and the grip 311 are disposed on opposite sides of a plane which includes the axis of striking movement of the hammer bit 119 and crosses the extending direction of the grip 311. Thus, vibration which is caused in the hammer drill 100 and transmitted to the user holding the grip part 310 is reduced.

In the second embodiment, the auxiliary handle 300 is provided with the torsion spring 342, but the present invention is not limited to this. It may include any biasing member for biasing the grip part 310 to hold it in a predetermined initial position with respect to the mounting part 330. For example, it may be an elastic element such as rubber and resin.

In view of the scope and spirit of the above-described invention, the auxiliary handle of the present invention can have the following features. The each feature may be utilized independently or in conjunction with claimed invention and/or other feature(s).

(1)

"An elongate auxiliary handle, which is removably attached to a reciprocating power tool in which a tool bit is caused to reciprocate in a predetermined direction, comprising:

a mounting part that is attached to a power tool body, a movable part that can move with respect to the mounting part and a connection part that connects the mounting part and the movable part, wherein:

the movable part has a grip part which is held by a user and a base which is disposed between the grip part and the connection part in a longitudinal direction of the auxiliary handle, and when the auxiliary handle is attached to the power tool body such that the longitudinal direction of the auxiliary handle crosses the predetermined direction, the movable part is held so as to be movable in the predetermined direction with respect to the mounting part with the connection part as a fulcrum and elastically biased toward an initial position by the connection part."

(2)

"When the auxiliary handle is attached to the power tool body such that the longitudinal direction of the auxiliary handle crosses the predetermined direction, the connection part and the grip part are disposed on opposite sides of a plane which includes an axis of striking movement of the tool bit and is perpendicular to the longitudinal direction."

(3)

"The power tool body includes a barrel part which houses a tool holder to which the tool bit is attached, the barrel part being disposed in a front region of the power tool body, wherein the auxiliary handle is attached to the barrel part." (Correspondences Between the Features of the Embodiments and the Features of the Invention)

Correspondences between the features of the embodiments and the features of the invention are as follow. Further, the above-described embodiments are representative examples for embodying the present invention, and the present invention is not limited to the constructions that have been described as the representative embodiments.

The hammer drill 100 is a feature that corresponds to the "reciprocating power tool" according to the present invention.

The auxiliary handles 200, 300 are features that correspond to the "auxiliary handle" according to the present invention.

The grip parts 210, 310 are features that correspond to the "grip part" according to the present invention.

The grip part 210 and the grip holding part 220 are features that correspond to the "movable part" according to the present invention.

The grip part 310 and the grip holding part 320 are features that correspond to the "movable part" according to the present invention.

The grip holding parts 220, 320 are features that correspond to the "base" according to the present invention.

The mounting parts 230, 330 are features that correspond to the "mounting part" according to the present invention.

The support parts 240, 340 are features that correspond to the "connection part" according to the present invention.

The first opening 241 is a feature that corresponds to the "bending rigidity reducing part" according to the present invention.

The second opening 242 is a feature that corresponds to the "bending rigidity reducing part" according to the present invention.

The nut 232 is a feature that corresponds to the "fastening member" according to the present invention.

The bolt 233 is a feature that corresponds to the "fastening member" according to the present invention.

The handle 234 is a feature that corresponds to the "operation part" according to the present invention.

The handle 234 is a feature that corresponds to the "movement amount controlling part" according to the present invention.

The sleeve 235 is a feature that corresponds to the "projection" according to the present invention.

The sleeve 235 is a feature that corresponds to the "movement amount controlling part" according to the present invention.

The mounting part 230 is a feature that corresponds to the "movement amount controlling part" according to the present invention.

The shaft 341 is a feature that corresponds to the "support shaft" according to the present invention.

The torsion spring 342 is a feature that corresponds to the "biasing member" according to the present invention.

DESCRIPTION OF NUMERALS

100 hammer drill
101 body
102 mode switching lever
104 barrel
107 handgrip
119 hammer bit
159 tool holder
190 battery mounting part
191 battery pack
200 auxiliary handle
210 grip part
211 grip
212 flange
220 grip holding part
221 through hole
230 mounting part
231 ring
232 nut
233 bolt
234 handle
235 sleeve
240 support part
241 first opening
242 second opening
300 auxiliary handle
310 grip part
311 grip
312 flange
320 grip holding part
321 through hole
330 mounting part
331 ring
332 nut
333 bolt
334 handle
340 support part
341 shaft
342 torsion spring

What we claim is:

1. An elongate auxiliary handle, which is removably attached to a reciprocating power tool in which a tool bit is caused to reciprocate in a predetermined direction, the auxiliary handle comprising:

a mounting part that is attached to a power tool body, a movable part that is movable with respect to the mounting part, and a connection part that connects the mounting part and the movable part, wherein:

the movable part has a grip part which is held by a user and a base which is disposed between the grip part and the connection part in a longitudinal direction of the auxiliary handle, when the auxiliary handle is attached to the power tool body such that the longitudinal direction of the auxiliary handle crosses the predetermined direction, (i) the movable part is held so as to be movable in the predetermined direction with respect to the mounting part with the connection part as a fulcrum, (ii) the connection part and the grip part are disposed, in the longitudinal direction, on opposite sides of a drive axis of the tool bit extending in the predetermined direction, and (iii) the connection part has smaller bending rigidity in the predetermined direction than the mounting part and the movable part, and the movable part is caused to move with respect to the mounting part by elastic deformation of the connection part.

2. The auxiliary handle as defined in claim 1, wherein the mounting part, the movable part and the connection part are integrally formed of a single material.

3. The auxiliary handle as defined in claim 1, wherein the auxiliary handle is formed of resin material and the connection part has a bending rigidity reducing part.

4. The auxiliary handle as defined in claim 1, further comprising a movement amount controlling part for controlling an amount of movement of the movable part with respect to the mounting part.

5. The auxiliary handle as defined in claim 4, further comprising a fastening member for fastening the mounting part to the power tool body, wherein the fastening member has a projection which protrudes from the mounting part in a state that the mounting part is mounted to the power tool body, and wherein the projection is configured to contact the movable part, thereby the projection serves as the movement amount controlling part by contact with the movable part.

6. The auxiliary handle as defined in claim 5, wherein:

the fastening member has an operation part that is manually operated by a user in order to fasten the mounting part to the power tool body, and the operation part is configured to contact the base and serves as a second movement amount controlling part which controls an amount of movement of the base in a direction crossing both the predetermined direction and the longitudinal direction by contact with the base, thereby controlling an amount of relative movement of the movable part.

7. The auxiliary handle as defined in claim 4, wherein the base is configured to contact the mounting part, and the mounting part serves as the movement amount controlling part which controls an amount of movement of the base in a direction crossing both the predetermined direction and the longitudinal direction by contact with the base, thereby controlling an amount of relative movement of the movable part.

8. The auxiliary handle as defined in claim 1, wherein, when the auxiliary handle is attached to the power tool body such that the longitudinal direction of the auxiliary handle crosses the predetermined direction, the movable part is and elastically biased toward an initial position by the connection part.

9. A reciprocating power tool having the auxiliary handle as defined in claim 1, further comprising a motor.

10. An elongate auxiliary handle, which is removably attached to a reciprocating power tool in which a tool bit is caused to reciprocate in a predetermined direction, the auxiliary handle comprising:

a mounting part that is attached to a power tool body, a movable part that is movable with respect to the mounting part, and a connection part that connects the mounting part and the movable part, wherein:

the movable part has a grip part which is held by a user and a base which is disposed between the grip part and the connection part in a longitudinal direction of the auxiliary handle, when the auxiliary handle is attached to the power tool body such that the longitudinal direction of the auxiliary handle crosses the predetermined direction, (i) the movable part is held so as to be movable in the predetermined direction with respect to the mounting part with the connection part as a fulcrum, and (ii) the connection part and the grip part are disposed, in the longitudinal direction, on opposite sides of a drive axis of the tool bit extending in the predetermined direction, the mounting part, the movable part and the connection part are integrally formed of a single material, and the movable part is caused to move with respect to the mounting part by elastic deformation of the connection part.

11. The auxiliary handle as defined in claim 10, wherein the auxiliary handle is formed of resin material and the connection part has a bending rigidity reducing part.

* * * * *